US011072010B2

(12) United States Patent
Moser

(10) Patent No.: US 11,072,010 B2
(45) Date of Patent: Jul. 27, 2021

(54) METHOD AND DEVICE FOR STRAIGHTENING A WORKPIECE

(71) Applicant: MOST Technik GmbH, Gmunden (AT)

(72) Inventor: Friedrich Moser, Scharnstein (AT)

(73) Assignee: MOST Technik GmbH, Gmunden (AT)

( * ) Notice: Subject to any disclaimer, the term of this patent is extended or adjusted under 35 U.S.C. 154(b) by 302 days.

(21) Appl. No.: 16/092,339

(22) PCT Filed: Apr. 10, 2017

(86) PCT No.: PCT/AT2017/050007
§ 371 (c)(1),
(2) Date: Oct. 9, 2018

(87) PCT Pub. No.: WO2017/177245
PCT Pub. Date: Oct. 19, 2017

(65) Prior Publication Data

US 2019/0160506 A1 May 30, 2019

(30) Foreign Application Priority Data

Apr. 13, 2016 (AT) ..... A 50321/2016

(51) Int. Cl.
*B21D 3/10* (2006.01)
*B21D 3/12* (2006.01)

(52) U.S. Cl.
CPC ..... *B21D 3/10* (2013.01); *B21D 3/12* (2013.01)

(58) Field of Classification Search
CPC ... B21D 3/10; B21D 3/12; B21D 3/14; B21D 3/16
See application file for complete search history.

(56) References Cited

U.S. PATENT DOCUMENTS 2,016,463 A * 10/1935 Sunnen ..... B21D 3/16 72/458
2,431,173 A 11/1947 Hawkes
3,583,191 A 6/1971 Colonius et al.
(Continued)

FOREIGN PATENT DOCUMENTS

AT 377456 B 8/1994
DE 150424 C 4/1904
(Continued)

OTHER PUBLICATIONS

Espacenet. English language translation of DE 40 22 951 (A1), Mitze, Manfred, Jan. 23, 1992.
(Continued)

*Primary Examiner* — Debra M Sullivan
(74) *Attorney, Agent, or Firm* — Tiajoloff & Kelly LLP

(57) ABSTRACT

The invention relates to method for straightening a workpiece (1) with a longitudinal axis, wherein the workpiece (1) is bent out of a starting position transversely to the longitudinal axis and bent back again. In order to provide advantageous straightening conditions, it is proposed that the workpiece (1), which is held on the end side in mounting heads (6), is bent out by means of the mounting heads (6) in directions changing at least in predetermined angular ranges, and bent back again.

10 Claims, 4 Drawing Sheets

(56) References Cited

U.S. PATENT DOCUMENTS

Figure 1:
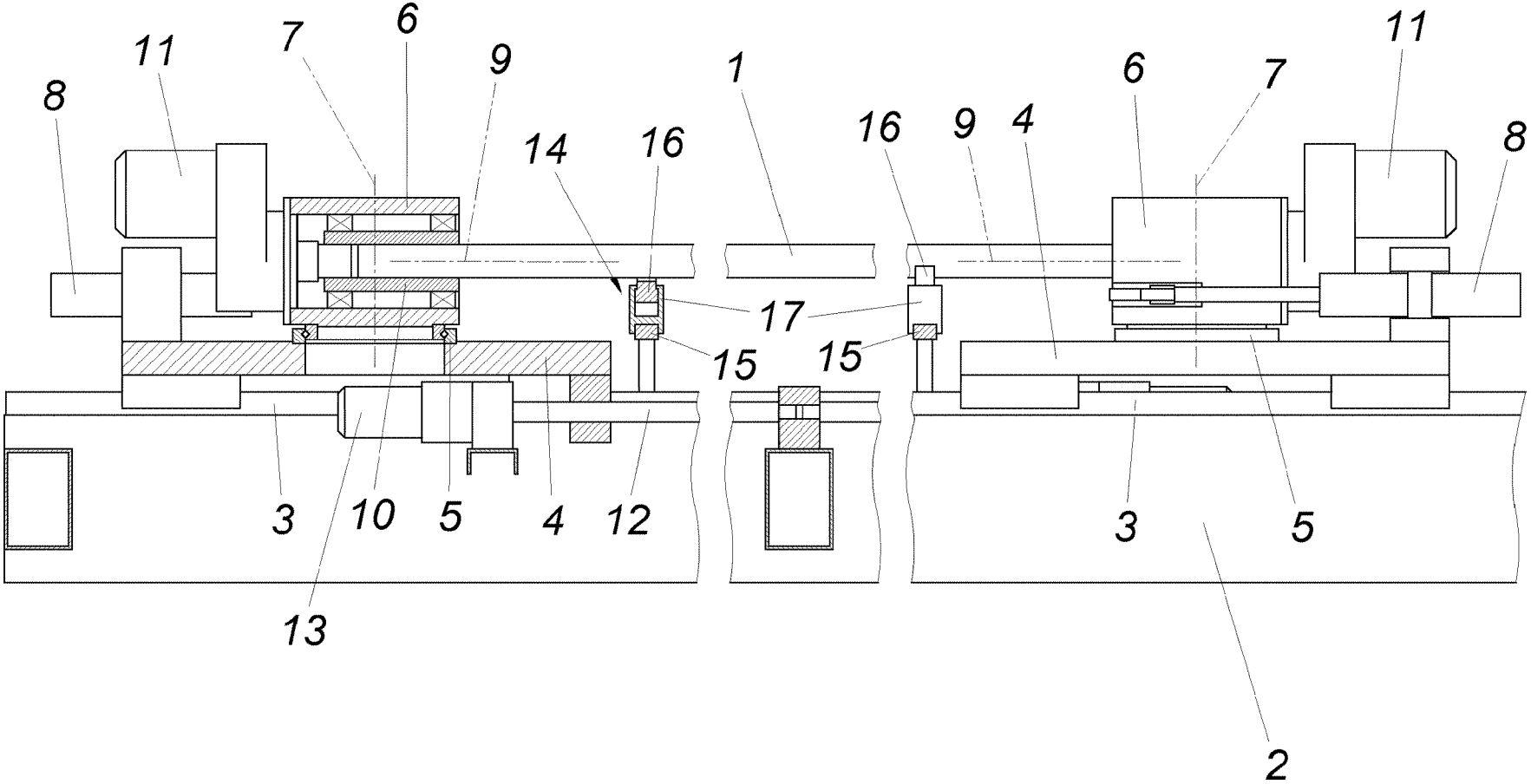

| | | | | |
|---|---|---|---|---|
| 4,483,175 | A * | 11/1984 | Hansen | B21D 3/10 72/390.5 |
| 4,700,439 | A | 10/1987 | Hines | |
| 4,912,957 | A * | 4/1990 | Petersen | B21D 3/10 72/17.3 |
| 2010/0095736 | A1* | 4/2010 | Kolbe | B21D 3/05 72/370.08 |
| 2013/0180307 | A1* | 7/2013 | Mitze | B21D 3/00 72/372 |

FOREIGN PATENT DOCUMENTS

| | | | |
|---|---|---|---|
| DE | 2006728 | A1 | 9/1970 |
| DE | 40 22 951 | A1 | 1/1992 |
| EP | 2 611 554 | B1 | 7/2013 |
| JP | H10-156436 | A | 6/1998 |

OTHER PUBLICATIONS

Espacenet English-language abstract of JPH10-156436 A, Jun. 16, 1998.

* cited by examiner

METHOD AND DEVICE FOR STRAIGHTENING A WORKPIECE

FIELD OF THE INVENTION

The invention relates to a method for straightening a workpiece with a longitudinal axis, wherein the workpiece is bent out from a starting position transversely to the longitudinal axis and bent back again, and to a device for carrying out the method.

DESCRIPTION OF THE PRIOR ART

For straightening workpieces with a pronounced longitudinal axis, such as rods, bars, profiles and tubes, transverse forces are exerted on the workpiece, which cause a bending transversely to the longitudinal axis and a bending back into the starting position, so that existing bending stresses are reduced by these opposing bending loads. Regardless of whether these transverse forces are applied via rollers or pressure jaws, there is the risk in the known straightening process that the straightening tools leave straightening marks on the surface of the straightened workpiece. In addition, the risk of overloading the profiles cannot be excluded by the transverse forces necessary for straightening in thin-walled profiles. In addition, the devices used require comparatively complex, heavy constructions.

DESCRIPTION OF THE INVENTION

The invention is therefore based on the object of designing a method for straightening elongated workpieces, in particular of profiles, hollow sections and tubes, such that the required straightening forces can be applied with relatively simple means without risk of surface damage to the workpieces to be straightened.

Based on a method of the type described, the invention solves the problem in that the workpiece held on the end side in mounting heads is bent out using the mounting heads in directions changing in at least predetermined angular ranges and bent back again.

The invention is based on the finding that in the bending of a workpiece by applying corresponding bending moments in the region of its two longitudinal ends, the workpiece is acted upon over its entire length with an approximately constant bending moment load, so that it is not necessary to apply bending forces in the region between the two longitudinal ends by appropriate straightening tools, as is the case in the prior art. It only needs to be ensured that the workpiece is bent out at least once in different directions from the starting position and bent back again into the starting position, namely depending on the cross-sectional shape of the workpiece in at least predetermined angular ranges, so that the residual stresses are relieved in different directions, without having to apply straightening tools along the workpiece. Consequently, any risk of damage to the workpiece surface by straightening tools can be prevented.

Particularly simple process conditions arise when the workpiece is bent out using the mounting heads in continuously changing directions and bent back again, because in this case a continuous straightening process can be ensured regardless of the orientation of existing residual stresses.

By choosing the mutual deflection of the mounting heads, an influence can be made on the bending line. Simple bending conditions arise in this context when the workpiece is bent out and bent back symmetrically to a plane perpendicular to the longitudinal center plane, which usually meets the straightening requirements.

The bending stress in continuously changing directions can be achieved via a corresponding drive of the mounting heads without rotation of the workpiece about its longitudinal axis. However, it is also possible in a simple manner to bend out the workpiece during its rotation about the longitudinal axis using the mounting heads in a plane and back again. Since the workpiece is rotated about its longitudinal axis during the bending stress on the two mounting heads, the bending moments act not only in one plane, but due to the workpiece rotation in all rotational positions, which also allows a reduction of the bending stresses in all directions.

For straightening a workpiece with a longitudinal axis, a device can advantageously be used which has two mounting heads which are mutually coaxially alignable and are adjustable relative to each other in the direction of the coaxial straightening axis and accommodate the workpiece at its longitudinal ends, said mounting heads each being rotatably mounted about two pivot axes extending transversely to the coaxial straightening axis and being drivable about these pivot axes. Due to this pivotable mounting of the mounting heads about two preferably mutually perpendicular pivot axes, the workpiece can be continuously subjected in changing directions to a bending load in a corresponding pivot drive about these pivot axes, which ensures an effective straightening in all directions. However, the bending of the workpiece requires a relatively mutually displaceable mounting of the mounting heads, so that the chord length of the bending line can be considered, which is shorter due to the deflection and corresponds to the mutual distance of the mounting heads.

However, the two mounting heads for end-side accommodation of the workpiece can also be rotatably mounted only about a pivot axis extending transversely to the coaxial straightening axis when the mounting heads are assigned a drive for rotating the workpiece about its longitudinal axis.

As a result of the mounting heads coaxially aligned to each, the workpiece to be straightened can be received in a starting position in order to be rotated about its longitudinal axis by means of the drive provided for this purpose. Since the mounting heads are rotatably mounted about pivot axes extending transversely to the coaxial straightening axis, corresponding bending moments can be exerted on the clamped workpiece via the mounting heads.

Particularly simple construction conditions arise when the pivot axes of the mounting heads extend in parallel, because in this case symmetrical loads relative to a center plane perpendicular to the longitudinal axis of the workpiece can be expected.

BRIEF DESCRIPTION OF THE INVENTION

Figure 2:
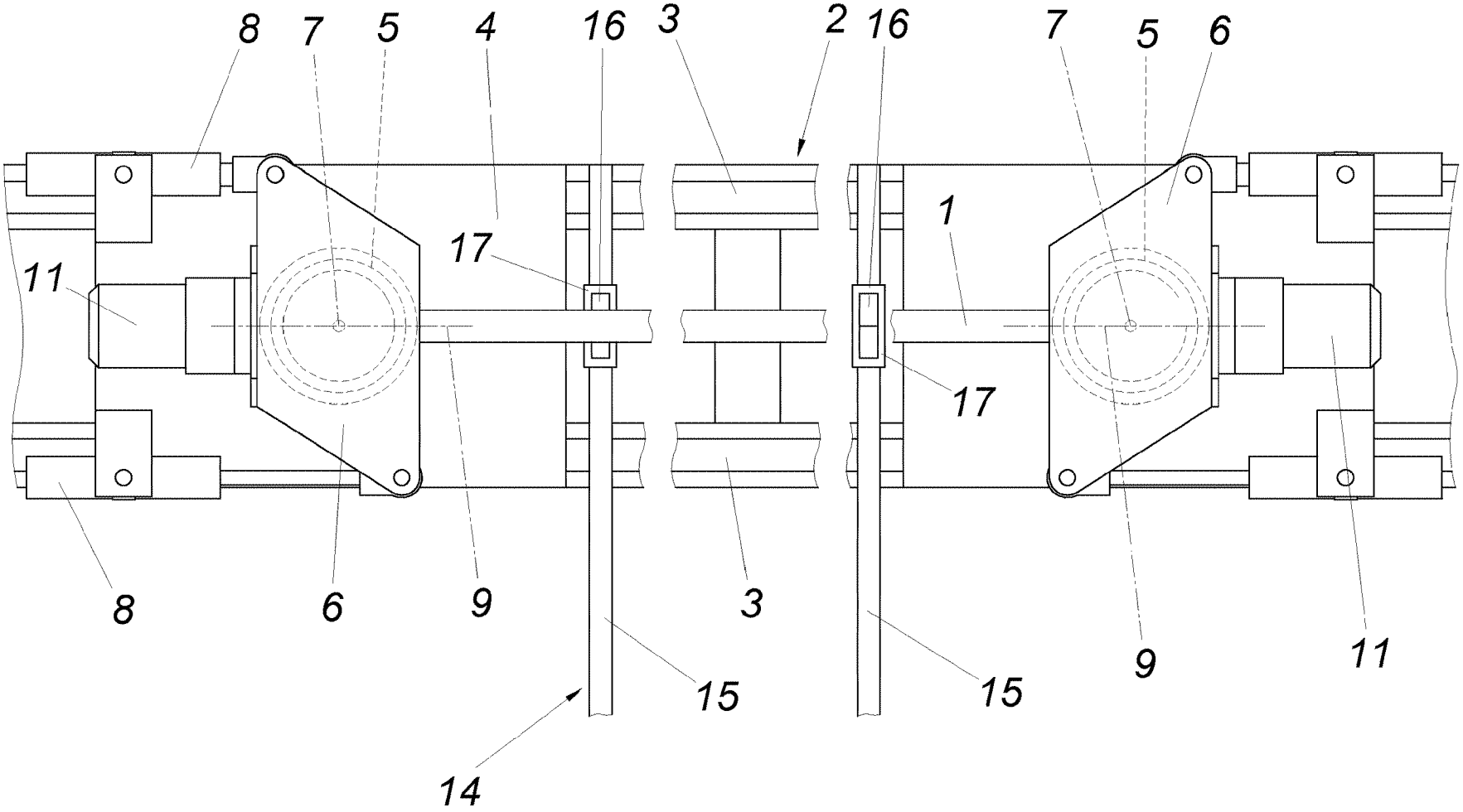
Figure 3:
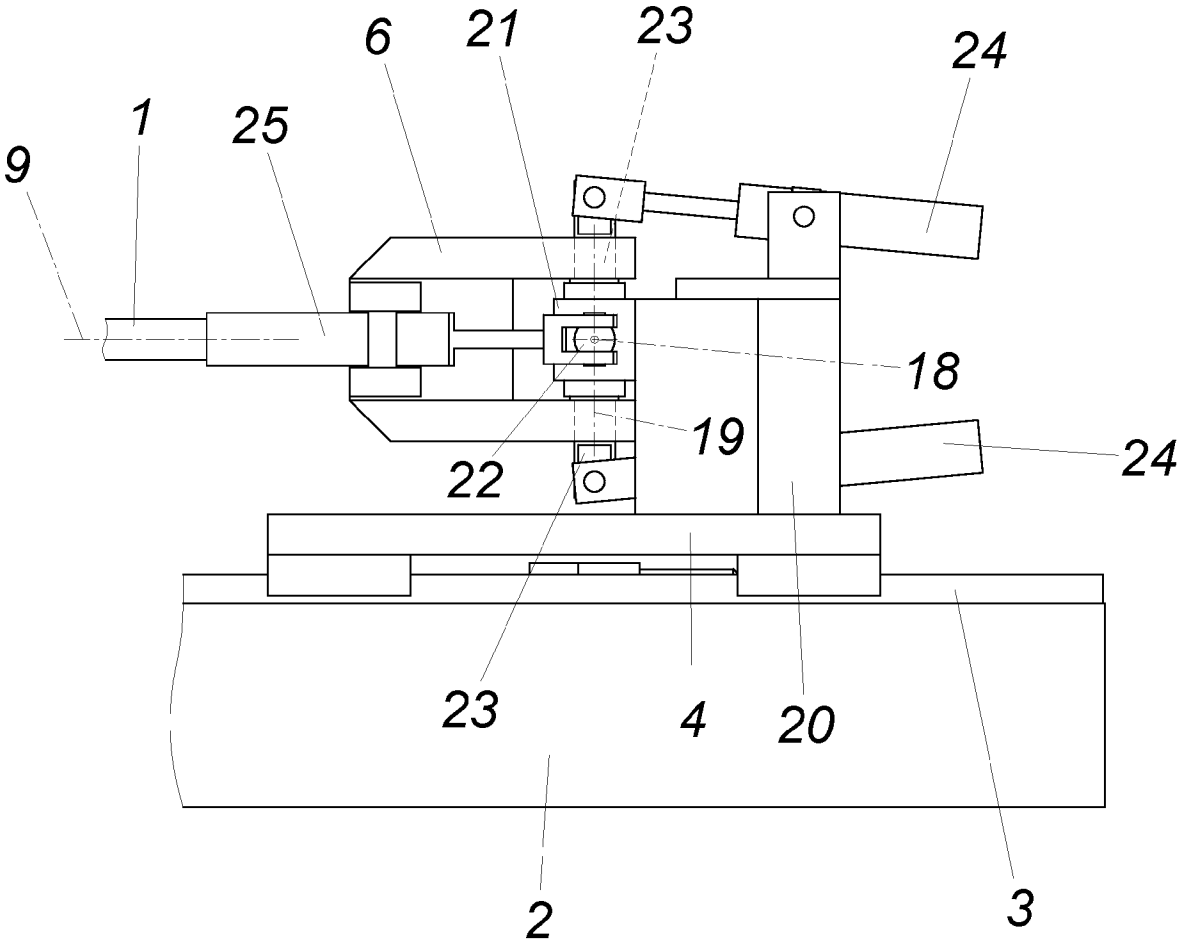
Figure 4:
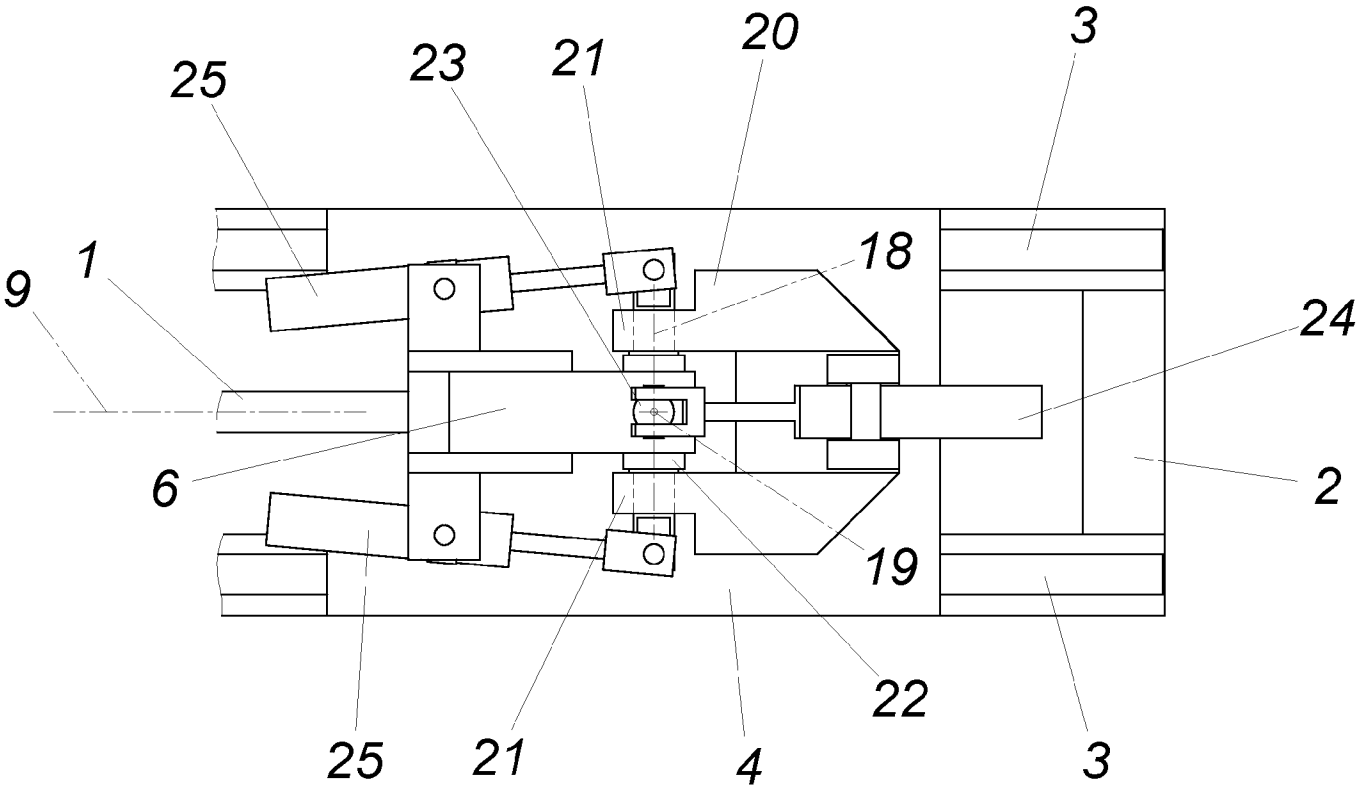

In the drawing, the subject invention is shown by way of example, wherein:

FIG. 1 shows a device according to the invention for straightening a workpiece with a pronounced longitudinal axis in a partly sectional, schematic side view, FIG. 2 shows this device in a plan view, FIG. 3 shows a construction variant of a straightening device according to the invention in the region of one of the two mounting heads in a schematic side view, and FIG. 4 shows the device of FIG. 3 in a plan view.

DESCRIPTION OF THE PREFERRED EMBODIMENTS

The device for straightening a workpiece 1, e.g. a pipe, comprises according to FIGS. 1 and 2 a frame 2 with guides 3 for two carriages 4, which each carry a turntable 5 for receiving a mounting head 6. The mounting heads 6 are thus rotatably mounted on the carriage 4 about a pivot axis 7, which extends transversely to the guides 3 and is indicated with the dash-dotted lines, and can be pivoted out by means of pivoting cylinders 8 from a starting position, which is determined by the mutually coaxially aligned mounting heads 6. This coaxial straightening axis of the mounting heads 6 extending in the direction of the guides 3 is denoted by reference numeral 9.

The two mounting heads 6, which comprise a rotatably mounted workpiece holder 10, are each associated with a drive 11 for the workpiece holder 10, so that the workpiece 1 can be driven in rotation about its longitudinal axis from its two ends.

For mutual displacement of the carriages 4, a spindle drive 12 is provided with two opposing spindle sections which are driven by a drive 13, so that the carriages 4 can be moved apart or towards each other.

Between the carriage 4, a transverse conveyor 14 is provided, which has receptacles 16 movable along rails 15 for workpieces 1 to be straightened. The workpieces 1 to be straightened can thus be introduced into the device when the carriages are moved apart via the transverse conveyor 14 in order to be received by the mounting heads 6 by moving the carriages 4 together. In order to ensure that the straightening process cannot be hindered by the receptacles 16 of the transverse conveyor 14, these receptacles 16 can be lowered and retracted from the region of the straightening device. In the illustrated embodiment, the receptacles 16 are designed in this case as actuating pistons which can be pressurized by a pressure medium, which pistons are provided in drivers 17 movable along the rails 15. The actuator for the driver 17 is not shown for reasons of clarity.

For straightening the workpiece 1, it is introduced into the straightening device in the described manner by means of the transverse conveyor 14 and is received by the mounting heads 6. After an extension of the driver 16 from the straightening region, the straightening process can be initiated in that first the drive 11 is turned on for the rotation of the workpiece 1 about its longitudinal axis. A bending moment can then be applied to the rotating workpiece 1 via the longitudinal ends gripped by the mounting heads 6, specifically by a corresponding actuation of the pivoting cylinders 8, so that the mounting heads 6 are pivoted out of the coaxial straightening axis 9 about the pivot axes 7. At the same time, the two mounting heads 6 must be pulled via the spindle drive 12 against each other in order to take into account the shortening of the mutual mounting head distance caused by the bending of the workpiece 1. After bending out from the starting position predetermined by the coaxial straightening axis 9, it is bent back into the starting position with continuous rotation of the workpiece 1, wherein the mounting heads 6 are pivoted back via the pivot cylinders 8 and at the same time the carriages 4 are moved apart again. On reaching the starting position, the straightening process is completed. The workpiece 1 can be removed from the straightening device via the transverse conveyor 14 once the workpiece 1 has been released by moving the mounting heads 6 apart.

According to the embodiment of FIGS. 3 and 4, the two mounting heads 6 are driven not only about a pivot axis, but are driven about two respective pivot axes 18, 19 which preferably stand perpendicularly to each other and extend transversely to the straightening axis 9, so that a rotary drive for the workpiece 1 about its longitudinal axis can be dispensed with and still a corresponding bending moment can be applied via the mounting heads 6 in continuously changing directions. For this purpose, the mounting heads 6 are mounted in the manner of a cardan joint in a frame structure 20, the bearing body 21 comprises a shaft 22 which forms the pivot axis 18 and carries the mounting head 6. On the shaft 22, two diametrically opposite stub axles 23 are attached to which an actuator in the form of pivot cylinders 24 engages, so that the shaft 22 and thus the mounting head 6 can be rotated via the actuating cylinders 24 about the pivot axis 18.

The mounting heads 6 are additionally rotatably mounted on the stub axles 23, which thus determine the pivot axis 19. For the rotary drive about the pivot axis 19, two pivoting cylinders 25 are again provided, which are articulated on the one hand on the mounting head 6 and on the other hand on the shaft. The mounting head 6 which is non-rotatably held in relation to the shaft 22 can therefore be additionally pivoted about the stub axle 23. Thus, the conditions are created to continuously bend out the workpiece 1 to be straightened in all directions and back again, without having to drive the workpiece itself in a rotating manner.

The invention claimed is:

1. A method for straightening a workpiece with a longitudinal axis and longitudinal ends, said method comprising:

holding the workpiece with mounting heads each holding a respective longitudinal end of the workpiece; and one or more bending steps each comprising bending the workpiece out from a starting position transversely to the longitudinal axis only by applying bending moments via the mounting heads; and then bending the workpiece back to the starting position only by applying bending moments via the mounting heads;

wherein the mounting heads in the one or more bending steps move so that, relative to the workpiece, the bending out and bending back is in more than one direction transverse to the longitudinal axis.

2. The method according to claim 1, wherein the bending out and the bending back of the workpiece are in directions that change continuously.

3. The method according to claim 2, wherein the bending out and the bending back of the workpiece is symmetrical to a center plane perpendicular to the longitudinal axis.

4. The method according to claim 2, wherein the bending out and the bending back of the workpiece is performed during a rotation of the workpiece about the longitudinal axis by the mounting heads.

5. The method according to claim 1, wherein the bending out and the bending back of the workpiece is symmetrical to a center plane perpendicular to the longitudinal axis.

6. The method according to claim 5, wherein the bending out and the bending back of the workpiece performed during a rotation of the workpiece about the longitudinal axis by the mounting heads.

7. The method according to claim 1, wherein the bending out and the bending back of the workpiece is performed during a rotation of the workpiece about the longitudinal axis by the mounting heads.

8. A device for straightening a workpiece with a longitudinal axis and two longitudinal ends, said device comprising:

two mounting heads configured to be aligned coaxially to each other, and supported to be adjustable relative to one another in a direction of a coaxial straightening axis;

said mounting heads each receiving a respective longitudinal end of the workpiece;

wherein each of said mounting heads is mounted so as to be rotatable about two pivot axes that extend transversely to the coaxial straightening axis; and wherein each of said mounting heads is driven so as to rotate about said pivot axes and apply bending forces to the workpiece held by the mounting heads in different directions transverse to the coaxial straightening axis.

9. A device for straightening a workpiece with a longitudinal axis and two longitudinal ends, said device comprising:

two mounting heads configured to be aligned coaxially to each other, and supported to be adjustable relative to one another in a direction of a coaxial straightening axis;

said mounting heads each receiving a respective longitudinal end of the workpiece;

wherein each of said mounting heads is mounted so as to be rotatable about a respective pivot axis extending transversely to the coaxial straightening axis, and the mounting heads are connected with a drive rotating the workpiece about said longitudinal axis such that the mounting heads apply bending forces to the workpiece held by the mounting heads in different directions transverse to the coaxial straightening axis.

10. The device according to claim 9, wherein the pivot axes of the mounting heads extend in parallel relative to each other.

* * * * *